US011497956B2

(12) United States Patent
Grissel, Jr.

(10) Patent No.: US 11,497,956 B2
(45) Date of Patent: Nov. 15, 2022

(54) COMBINATION EXERCISE RACK ADJUSTMENT DEVICE

(71) Applicant: Coulter Ventures, LLC., Columbus, OH (US)

(72) Inventor: Timothy Keith Grissel, Jr., Cedar Rapids, IA (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 17/085,391

(22) Filed: Oct. 30, 2020

(65) Prior Publication Data

US 2021/0128970 A1 May 6, 2021

Related U.S. Application Data

(60) Provisional application No. 62/927,821, filed on Oct. 30, 2019.

(51) Int. Cl.
*A63B 21/078* (2006.01)

(52) U.S. Cl.
CPC ..... *A63B 21/078* (2013.01)

(58) Field of Classification Search
CPC ..... A63B 1/00; A63B 21/078; A63B 23/1218; A63B 21/0552; A63B 21/0414; A63B 21/072; A63B 2209/08; A63B 23/03525; A63B 23/04; A63B 2225/093; A63B 23/03575

See application file for complete search history.

(56) References Cited

U.S. PATENT DOCUMENTS

2002/0111258 A1* 8/2002 Slattery ..... A63B 21/4029 482/142
2015/0306443 A1* 10/2015 Bruni, Jr. ..... A63B 21/0724 482/104
2020/0101342 A1* 4/2020 Lawton ..... A63B 21/00181

* cited by examiner

*Primary Examiner* — Andrew S Lo
*Assistant Examiner* — Andrew M Kobylarz
(74) *Attorney, Agent, or Firm* — Banner & Witcoff, Ltd.

(57) ABSTRACT

A combination exercise rack adjustment device allows the combination exercise rack to have multiple positions for an upright. The positions translate to different angles that are used for specific exercises such as bench press and squats. The device has a cam with an extension that dictates the angle of the upright. In the preferred embodiment, a post is described that includes the adjustment device.

16 Claims, 7 Drawing Sheets

COMBINATION EXERCISE RACK ADJUSTMENT DEVICE

CROSS-REFERENCE TO RELATED APPLICATIONS

The present application claims priority to provisional patent application 62/927,821 which was filed on Oct. 30, 2019, and is hereby expressly incorporated by reference in its entirety.

BACKGROUND

In powerlifting, there is a popular weightlifting apparatus, known as a combo rack or a combination exercise rack. The apparatus is named due to its ability to be converted from a squat exercise to a bench press exercise during a powerlifting meet. Accordingly, there is a reduction in the number of necessary pieces of equipment. Part of the operation of the combo rack in the squat orientation is to adjust the uprights of the rack for width depending on the size of the lifter (you could have a 114 lb lifter or a 400+ lb lifter squatting in the same unit). A typical existing combo rack post has a pivot point for the upright located at the bottom with a couple of thumb screws welded to a collar that allows the upright to pivot and then lock. While the prior art is somewhat effective it is cumbersome and can be loose.

It is an object of the present invention to facilitate easier adjustability for a combo rack upright.

SUMMARY OF THE INVENTION

The current invention is a device that controls the movement of the upright of a combination exercise rack wherein the pivot point is nearer the top of the post to create a more precision fit and make the joint tighter. Additionally, the device can include the post of the combination exercise rack. The device has a cam that operates with a simple lock collar knob that when loosened a quarter turn allows the upright to move into the alternate position and then be easily locked in place with just tightening the lock collar knob by hand.

DETAILED DESCRIPTION

Figure 1:
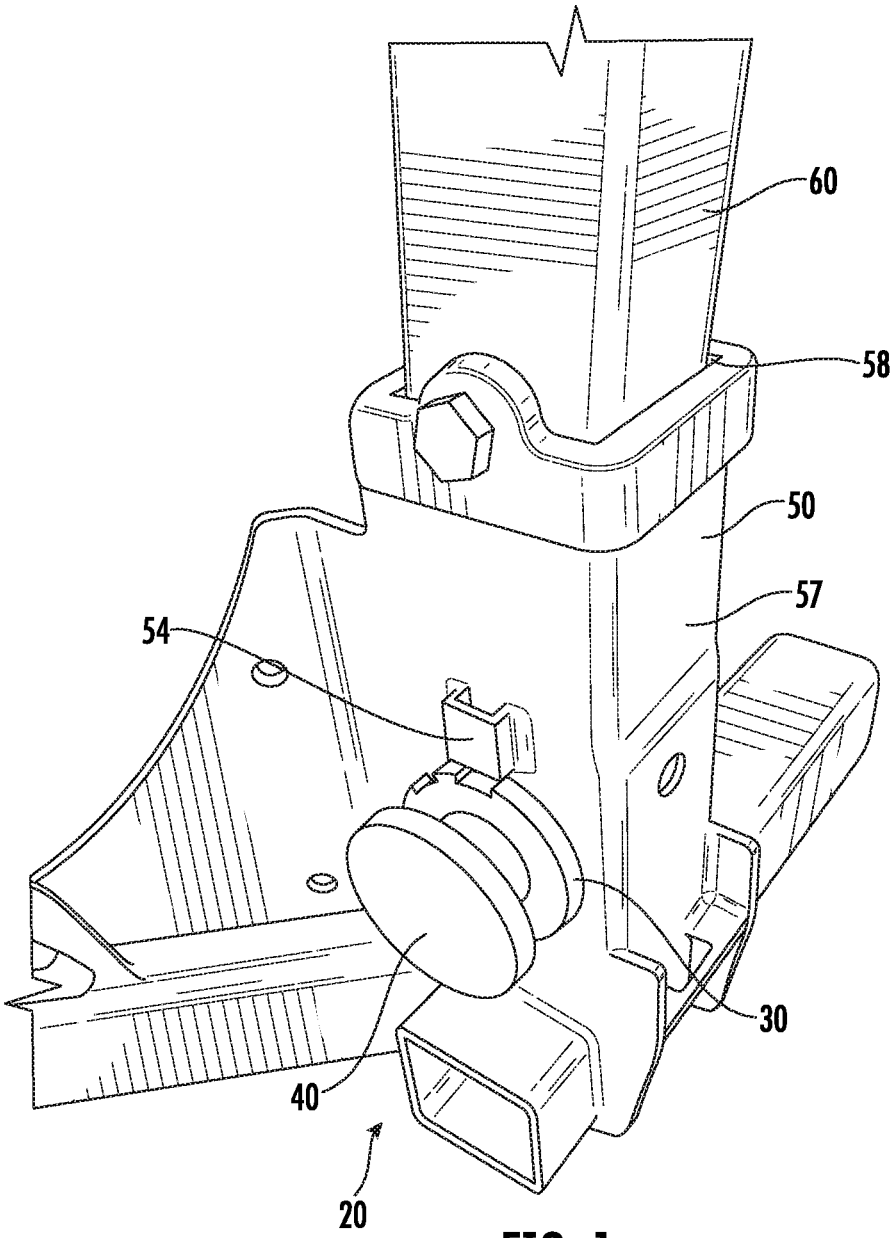
FIG. 1 is a perspective view of an upright of a combination exercise rack with an adjustment device.
Figure 2:
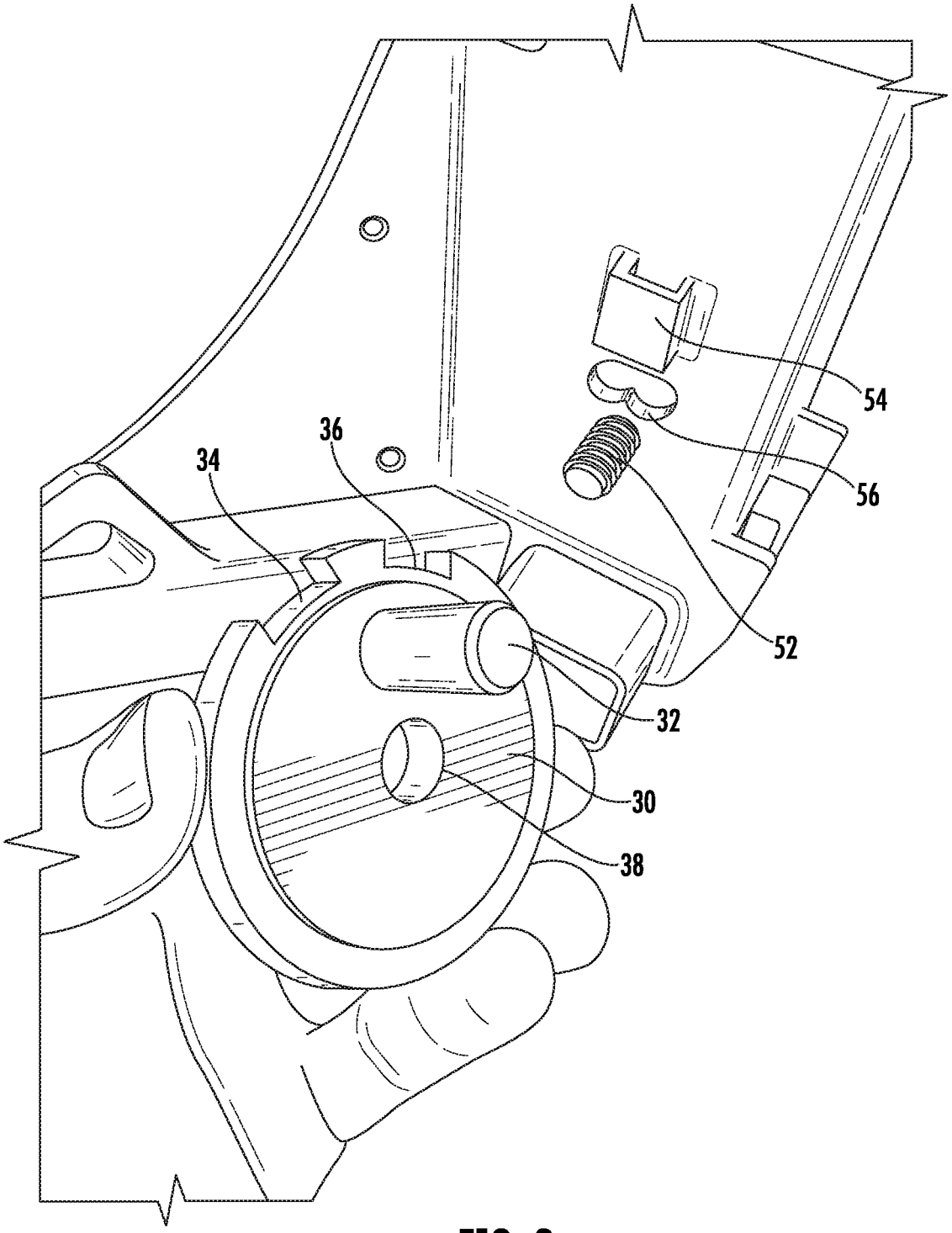
FIG. 2 is a perspective view of the cam member next to the post.
Figure 3:
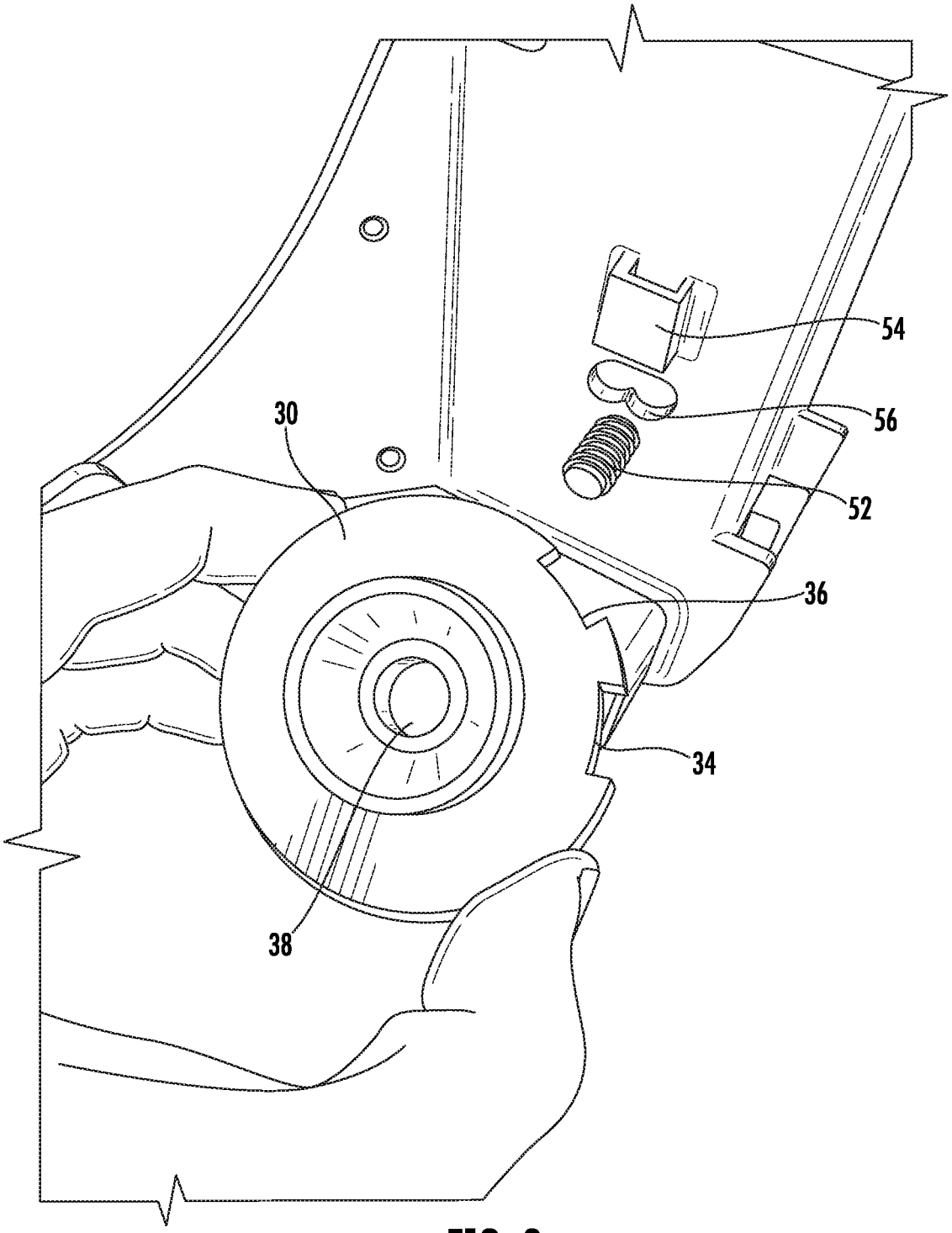
FIG. 3 is a perspective view of the cam member next to the post.

Now referring to the drawings, FIGS. 1-9 show a combination exercise rack adjustment device 20. As best seen in FIGS. 2 and 3, the adjustment device 20 has a cam 30. The cam 30 has an extension member 32, a first recess 34 and a second recess 36. The cam also has an opening 38 which can accommodate a connecting member 52 of a post 50 configured to receive an upright 60.

Figure 4:
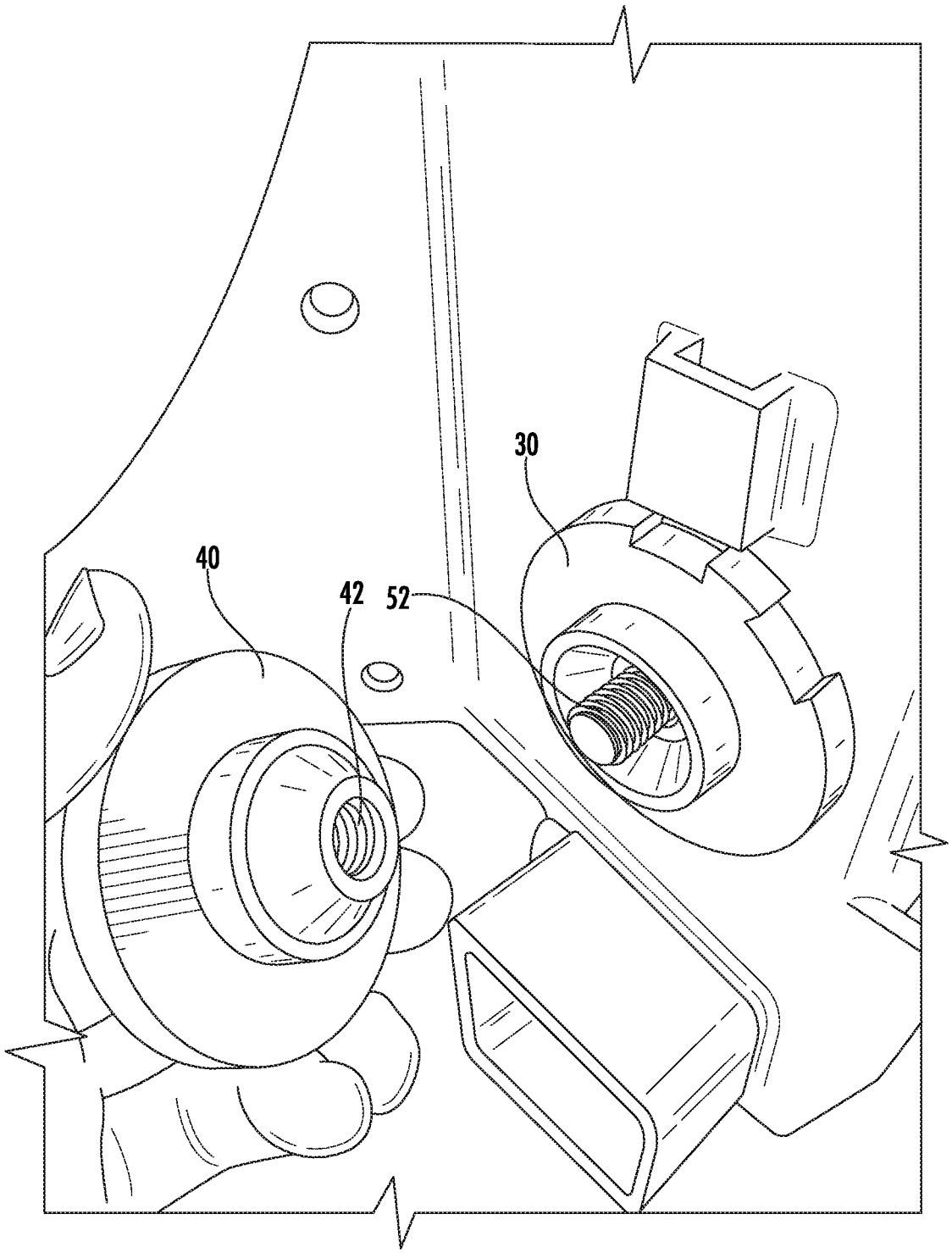
FIG. 4 is perspective view of the mounted cam member and the locking member.
Figure 5:
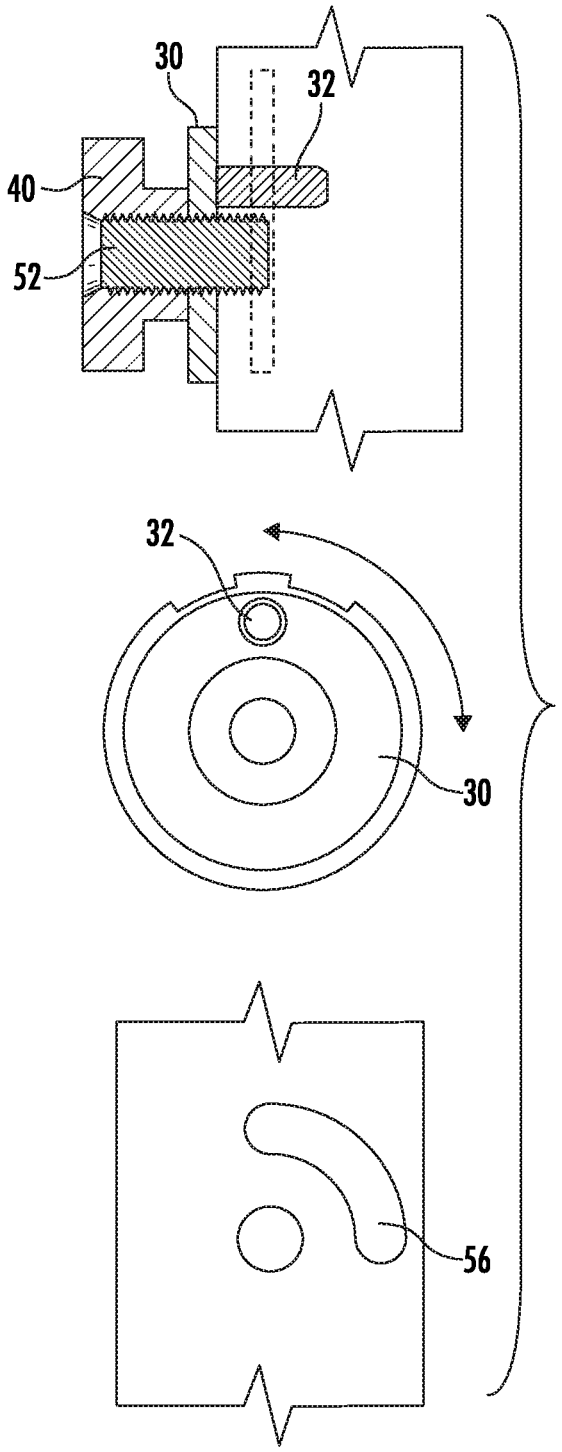
FIG. 5 is a cross-sectional view of the adjustment device on the post, and direction of turn.

As seen in FIG. 4, a locking member 40 serves as a cover as well as maintaining the position of the cam 30. Preferably the locking member 40 is lock collar knob. The locking member 40 has an opening 42 that is preferably threaded to correspond to threads of the connecting member 52. The locking member 40 is then simply screwed onto the connecting member 52 until tightened.

Figure 8:
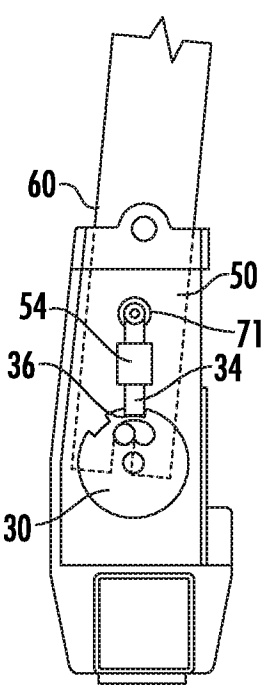
FIG. 8 is an end view of the adjustment device in a second position on a post.
Figure 7:
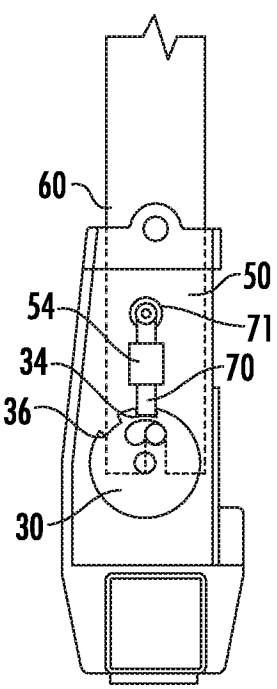
FIG. 7 is an end view of the adjustment device in a first position on a post.
Figure 6:
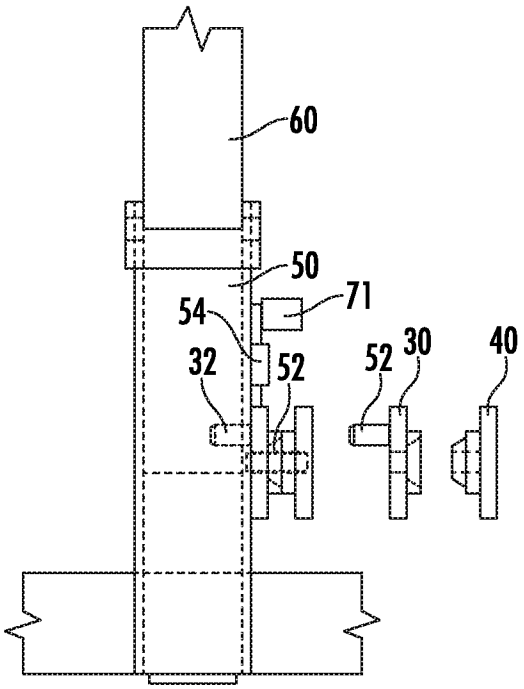
FIG. 6 is a side view of the adjustment device.
Figure 9:
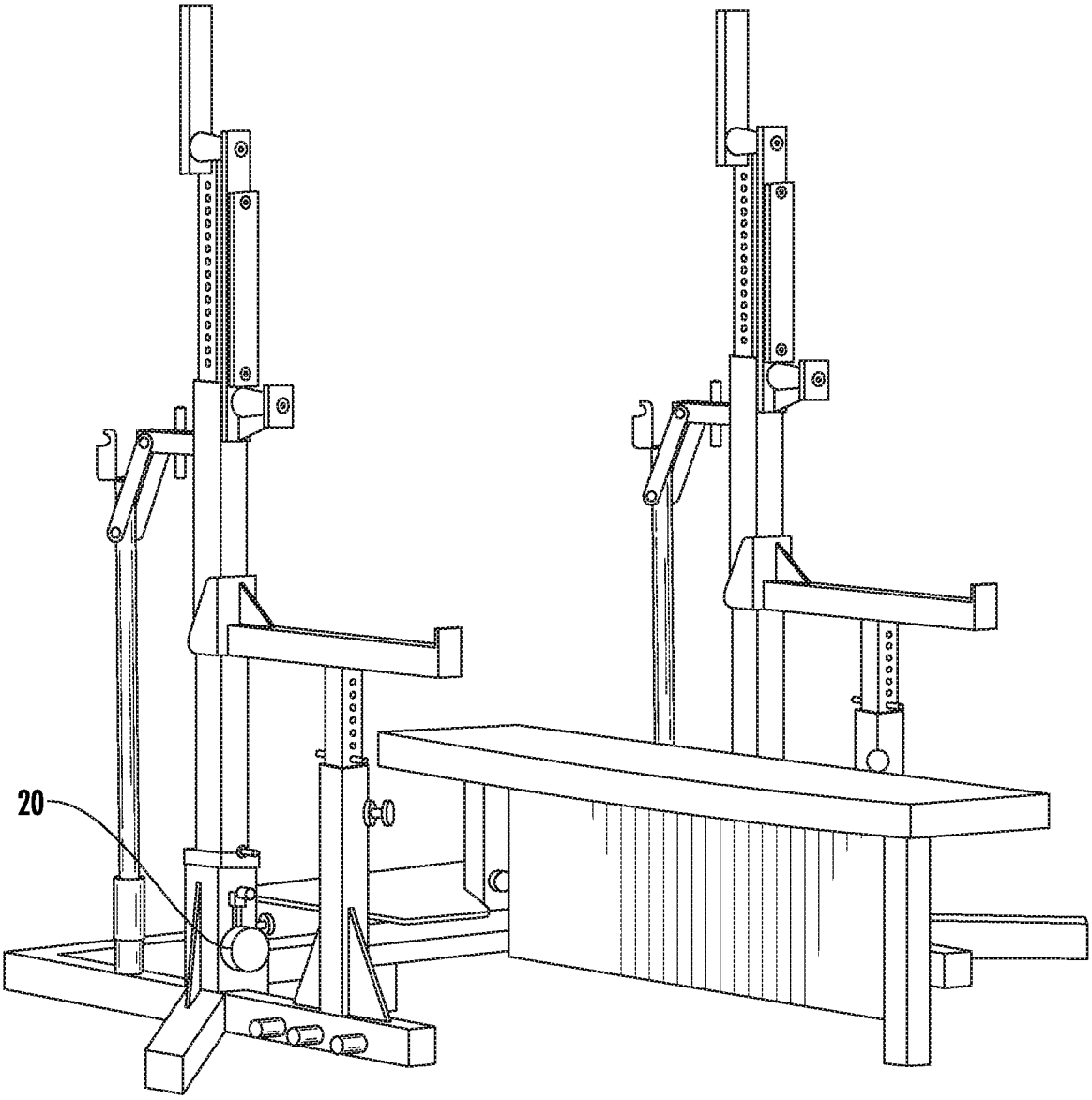
FIG. 9 is a perspective view of a combo rack with the adjustment device.

As best shown in FIGS. 6-8, the preferred embodiment of the post 50 includes the exercise rack adjustment device 20. The post 50 has the connecting member 52, a retaining member 54, an opening 56, and a main body 57 that is at least partially hollow to form a cavity 58. These elements of the post 50 interact with the cam 30 and locking member 40.

In use, the cam 30 is placed such that the extension member 32 is within the opening 56 of the post 50 and that the connecting member 52 fits into the opening 38 of the cam 30. The cam 30 is then turned to the desired location which is having either the first recess 34 or second recess 36 under the retaining member 54 of the post 50. The first recess 34 correlates to a first position and the second recess correlates to the second position. The locking member 40 is then placed on the connecting member 52 and tightened to maintain the cam 30 in either the first position or second position.

To further assist maintaining the selected position of the cam 30, a retaining bar 70 can be selectively inserted through the retaining member 54 as shown in FIGS. 7 and 8. Furthermore, a second locking member 71 is attachable to the retaining bar 70 to further secure the retaining bar 70 and thus the cam 30 in the selected position.

Depending on the position selected, an upright 60 placed in the cavity 58 will have a different angle as shown in FIGS. 7 and 8.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. An adjustment device for an upright of a combination exercise rack, comprising:

a cam;

the cam having a first position and a second position;

the cam configured to be mounted on a post of the combination exercise rack;

a locking member to lock the cam in place;

wherein the upright is configured to be inserted and hinged to the post to allow the upright to be positioned in at least two angles relative to the post depending on whether the cam is in the first position or the second position.

2. The adjustment device of claim 1, wherein:

the cam has a first recess.

3. The adjustment device of claim 2, wherein:

the cam has a second recess.

4. The adjustment device of claim 3, wherein:

the cam has an extension member;

the extension member is configured for the upright to rest on.

5. The adjustment device of claim 4, wherein:
the locking member is threaded.
6. The adjustment device of claim 5, wherein:
a retaining bar is configured to be selectively removable from the first recess.
7. A post for a combination exercise rack, comprising:
a main body;
the main body at least partially hollow;
the main body configured to receive an upright;
a cam;
the cam having a first position and a second position;
the cam configured to be selectively mounted on the main body;
a locking member to lock the cam in place;
wherein the upright is configured to be inserted and hinged to the main body to allow the upright to be positioned in at least two angles relative to the main body depending on whether the cam is in the first position or the second position.
8. The post of claim 7, wherein:
the cam has a first recess.
9. The post of claim 8, wherein:
the cam has a second recess.
10. The post of claim 9, wherein:
the cam has an extension member;
the extension member is configured for the upright to rest on.
11. The post of claim 10, wherein:
the locking member is threaded.
12. The post of claim 11, wherein:
a retaining bar is configured to be selectively removable from the first recess.
13. The post of claim 12, wherein:
the post has a retaining member;
the retaining member holds the retaining bar in place.
14. The post of claim 7, wherein:
the post has a connecting member;
the connecting member interacts with the locking member.
15. The post of claim 7, wherein:
the post has an opening;
the opening receives an extension member.
16. The post of claim 13, wherein:
a second locking member is selectively connected to the retaining bar.

* * * * *